US005565732A

United States Patent [19]

Sluyterman et al.

[11] Patent Number: 5,565,732

[45] Date of Patent: Oct. 15, 1996

[54] COLOR DISPLAY TUBE SYSTEM WITH REDUCED SPOT GROWTH

[75] Inventors: Albertus A. S. Sluyterman; Lambert J. Stil, both of Eindhoven, Netherlands

[73] Assignee: U.S. Philips Corporation, New York, N.Y.

[21] Appl. No.: 427,780

[22] Filed: Mar. 2, 1994

Related U.S. Application Data

[63] Continuation of Ser. No. 859,188, Mar. 27, 1992, abandoned.

[30] Foreign Application Priority Data

Apr. 2, 1991 [EP] European Pat. Off. ..... 91200761

[51] Int. Cl.[6] ..... H01J 29/70

[52] U.S. Cl. ..... 313/440; 348/830; 335/210

[58] Field of Search ..... 313/440; 348/830; 335/210

[56] References Cited

U.S. PATENT DOCUMENTS 4,405,910 9/1983 Ohtsu ..... 335/210
4,961,021 10/1990 Oguro et al. ..... 313/440 X
5,182,487 1/1993 Ohtsu ..... 313/440

FOREIGN PATENT DOCUMENTS 0244908 4/1987 European Pat. Off. .
0421523 9/1990 European Pat. Off. .
56-109439 8/1981 Japan .
2013971 2/1979 United Kingdom .

*Primary Examiner*—Sandra L. O'Shea
*Assistant Examiner*—Matthew J. Esserman
*Attorney, Agent, or Firm*—Robert J. Kraus

[57] ABSTRACT

A color display tube system having an electron gun producing three co-planar electron beams which are non-convergent, i.e. parallel or divergent. A convergence element located at a distance from the electron gun and coaxial with the tube axis then produces convergence of the electron beams at the display screen by generating a static 45° 4-pole field. This combination reduces growth of the scanning beam spot in the horizontal direction at the ends of the horizontal axis, which is a problem encountered with electron guns which are convergent.

15 Claims, 5 Drawing Sheets

COLOR DISPLAY TUBE SYSTEM WITH REDUCED SPOT GROWTH

This is a continuation of prior application Ser. No. 07/859,188, filed on Mar. 27, 1992, now abandoned.

BACKGROUND OF THE INVENTION

1. Field of the Invention

The invention relates to a colour display tube system comprising: a) an evacuated envelope having a neck, a cone and a display window, b) an electron gun in the neck, which gun has a beam-forming part for generating a central electron beam and two outer electron beams whose axes are co-planar, and an electrode system which in operation constitutes a main lens, c) a deflection unit for generating deflection fields for deflecting the electron beams in the horizontal and vertical directions and for scanning the display window by means of convergent beams.

2. Description of the Related Art

Colour display tube systems of the type described in the opening paragraph are commonly referred to as 3-in-line systems. Generally, the guns of these systems are constructed so that the outer beams converge upon leaving the gun, and comprise self-convergent deflection units which in operation generate non-uniform magnetic fields for horizontal and vertical deflection (particularly a barrel-shaped field for the vertical deflection and a pincushion-shaped field for the horizontal deflection) so that the three electron beams generated by the electron gun and focused on the display screen by the main lens converge throughout the display window.

However, these deflection fields cause the horizontal spot growth to increase by a given factor in the case of deflection, which factor may be more than two in 110° colour display tube systems. This notably means that in a normal self-convergent system, in which the three guns are located in a horizontal plane, a circular central spot becomes narrower in the vertical direction and very elongate in the horizontal direction when scanning the screen. As a result a loss of resolution occurs in the horizontal direction and there is a risk of Moiré problems owing to the spot becoming narrower vertically and the existence of horizontal dams in the shadow mask. The increasingly strict requirements imposed on the definition of the image, notably in high-resolution colour monitor tubes or when using colour display tubes for high-definition television with an aspect ratio of approximately 9:16 of the display window, require that at the ends of the horizontal axis the spot should be small in the horizontal direction.

SUMMARY OF THE INVENTION

It is one of the objects of the invention to provide a colour display tube of the type described in the opening paragraph in which the spot dimensions at the ends of the horizontal display screen axis are reduced in the horizontal direction (and in which the vertical spot dimension is preferably enlarged).

To achieve this object, a colour display tube according to the invention is characterized in that the electron gun produces non-convergent beams and in that an element producing convergence is arranged between the electron gun and the side of the deflection unit facing the display window, which element generates a static magnetic field exerting a force on each outer electron beam having a component in the plane of the electron beams directed towards the central electron beam.

The invention is based on recognition of the following. In operation, the electron gun produces outer electron beams which are parallel to the central beam or which may diverge for obtaining an even greater effect. These outer beams are then bent towards each other at a given distance from the gun. The two effects, introduced by the invention, on the convergence of the electron beams are dimensioned in such a way that there is convergence at the screen. The object of the invention is achieved in that the apex angle of each outer electron beam is separately enlarged in the horizontal direction (i.e. in a direction parallel to the plane of the non-deflected beams), which results in a reduction of the spot in the horizontal direction. The apex angle is understood to mean the angle between the outer electron paths of a given beam.

The magnetic field to be generated for producing the desired effect on convergence may comprise local dipole fields at the location of each of the two outer beams. For an improved focusing of the electron beams, however, a preferred embodiment of the invention is characterized in that the element producing convergence is constructed so that in operation it generates a 45° magnetic 4-pole field. The extent of non-convergence and convergence can be adjusted in such a way that a desired reduced spot dimension is realised in the horizontal direction at the ends of the horizontal display screen axis. The spot in the centre is then also reduced. Since the effect of spot growth in the horizontal direction, inherent in the use of self-convergent fields, is now substantially reduced, the spot in the centre will be smaller than the spot at the ends of the horizontal display screen axis. The invention is based, inter alia, on the recognition that this is no drawback because before the spot can never become too small in the horizontal direction the bandwidth of the video amplifier will become the limiting factor. The magnetic field to be generated for realising convergence may be generated, for example, by means of permanent magnets or by means of a configuration of electric coils which are energized with a (substantially constant) direct current.

If the magnetic field used for producing convergence is generated by means of a configuration of electric coils, these coils may be wound on an annular core coaxially surrounding the neck of the tube between the electron gun and the deflection unit. If the configuration of electric coils of the convergence unit is arranged on the annular core of the deflection unit itself, the deflection to produce convergence is effected at a larger distance from the gun, which is favourable for the envisaged effect. The same holds for the use of a permanently magnetized ring for producing convergence. The larger the distance from the gun, the greater the effect. A location within the deflection unit is thus very favourable, for example, a location within and coaxial with the system of line deflection coils or between the annular core and the system of line deflection coils. The permanently magnetized ring may alternatively be arranged within the tube.

BRIEF DESCRIPTION OF THE DRAWINGS

Some embodiments of the invention will now be described in greater detail by way of example with reference to the accompanying drawings in which.

Where applicable, identical reference numerals are used for identical components.

DESCRIPTION OF THE PREFERRED EMBODIMENTS

Figure 1A:
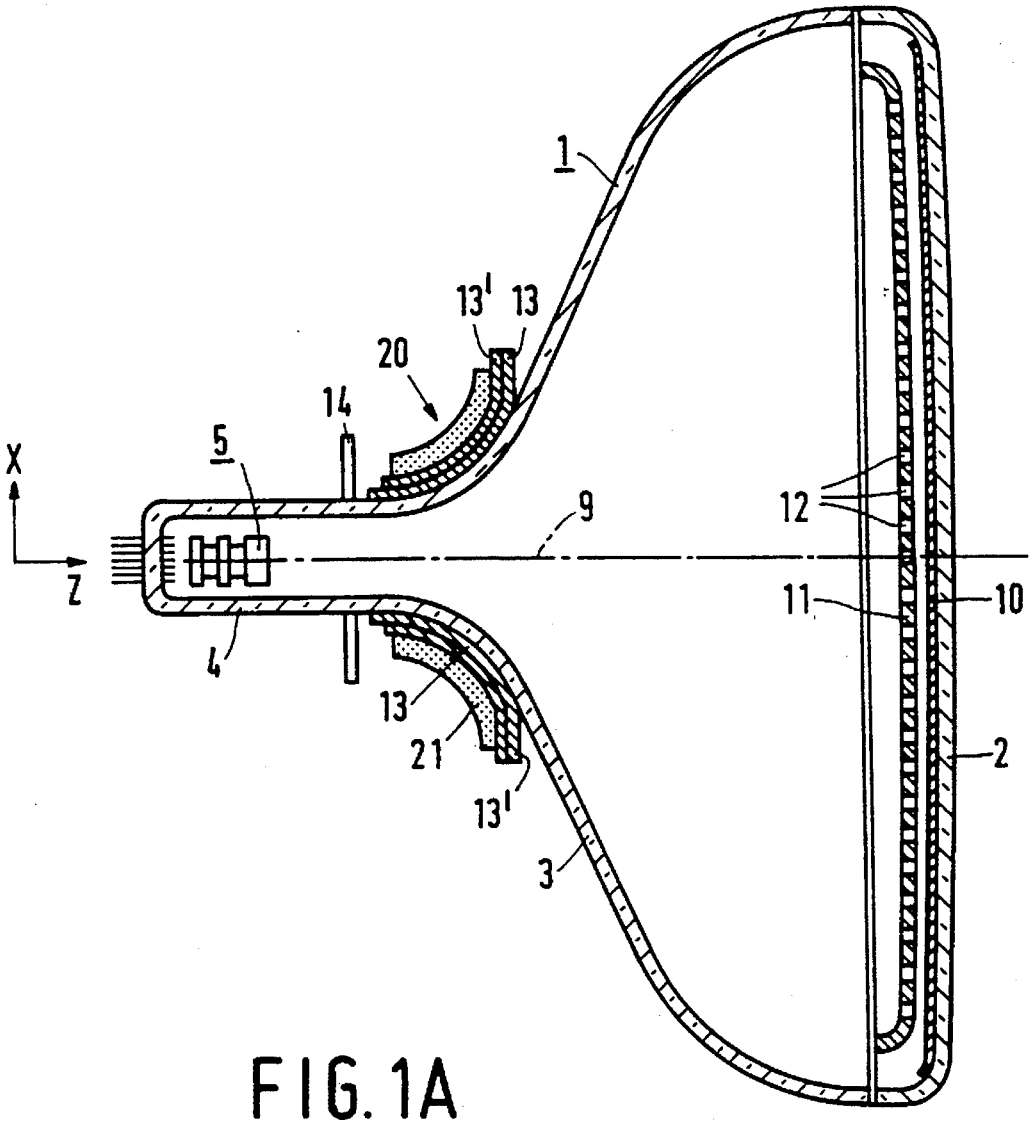
FIG. 1A is a longitudinal section of a colour display tube system according to the invention, including an element 14 producing convergence.

FIG. 1 is a cross-section of a colour display tube system according to the invention. A glass envelope 1, which is composed of a display window 2, a cone 3 and a neck 4, accommodates an electron gun 5 in this neck, which gun generates three non-converging electron beams whose axes are located in the plane of the drawing. In the non-deflected state, the axis of the central electron beam coincides with the tube axis 9. The display window 2 has a large number of triplets of phosphor elements on its inner side. The elements may consist of, for example, rows or dots. Each triplet comprises a green-luminescing phosphor, a blue-luminescing phosphor and a red-luminescing phosphor. A shadow mask 11 is arranged in front of the display screen, which mask has a large number of apertures 12 through which the electron beams pass and each impinge upon phosphor elements of one colour only. The three non-converging electron beams are deflected by a deflection unit 20 comprising a system 13 of line deflection coils and a system 13' of two diametrical field deflection coils, as well as an annular core 21 coaxially surrounding at least the system 13 of line deflection coils.

Figure 1B:
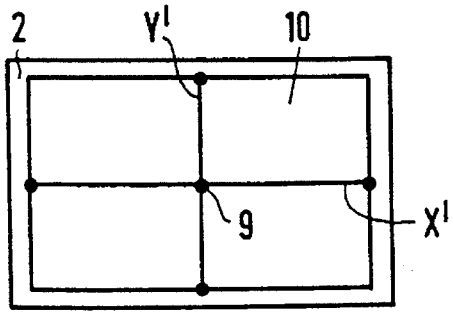
FIG. 1B is an elevational view of a display screen.

Characteristic of the invention is a coaxial element 14 arranged at a relatively large distance from the gun 5 for generating a magnetic field configuration which drives the (non-convergent) outer electron beams in the plane of the electron beams towards each other for realising convergence, all this in such a manner that the spot is small enough in the horizontal direction at the ends of the horizontal display screen axis X' (see FIG. 1B).

Figure 2A:
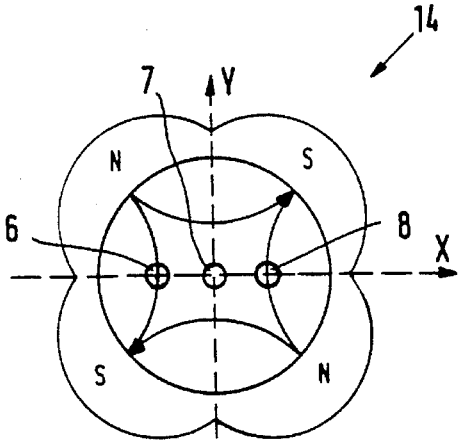
FIGS. 2A and 2B are elevational views of elements 14 producing convergence and implemented as 45° 4-pole elements.

The magnetic field configurations to be used may comprise local dipole fields generated by means of permanent magnets or by configurations of coils at the location of the outer beams 6 and 8 (see FIG. 2A). Magnetic pole shoes (not shown) may be arranged on the tube neck 4 so as to provide the dipole fields at the correct locations. However, magnetic field configurations comprising a 45° 4-pole field are preferably used. Such 4-pole fields may be generated, for example, by means of systems of permanent magnets. It is alternatively possible (see FIG. 2B) to generate these fields by means of a ring 14' of permanent magnetic material in which a suitable configuration of magnetic poles is induced.

Figure 2B:
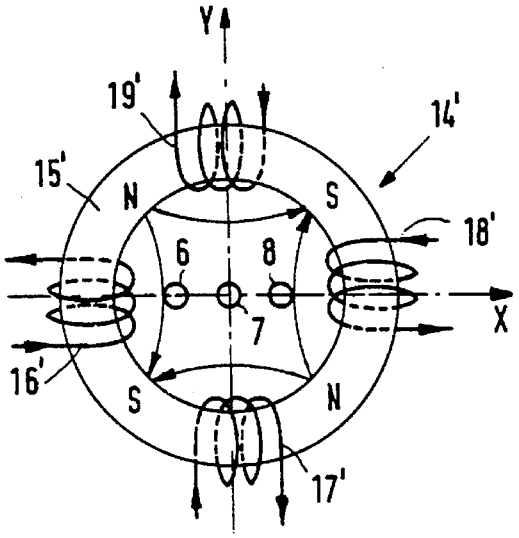
Figure 6:
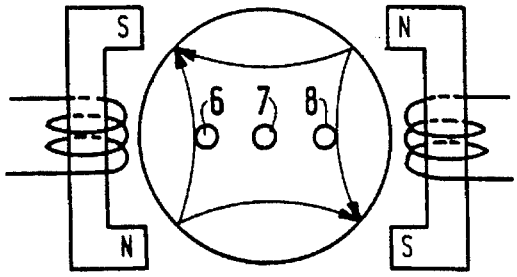
FIGS. 6 and 7 are elevational views of alternative embodiments of 45° 4-pole elements.
Figure 7:
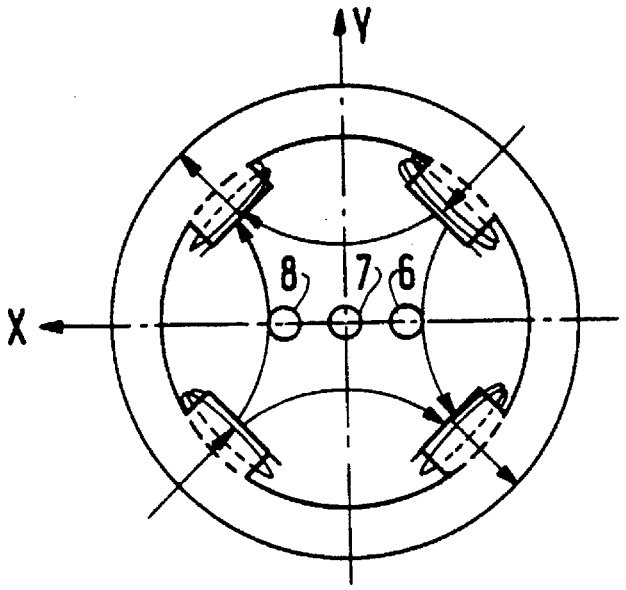

In the embodiment shown in FIG. 2B element 14' comprises an annular core 15' of a magnetizable material which coaxially surrounds the tube neck (4) and on which four coils 16', 17', 18' and 19' are wound in such a way that a 45° 4-pole field having the orientation shown with respect to the three co-planar beams 6, 7 and 8 is generated upon energization. (A 45° 4-pole field may be generated in an alternative way by means of two wound C cores, as shown in FIG. 6, or by means of a stator construction, as shown in FIG. 7).

Figure 3:
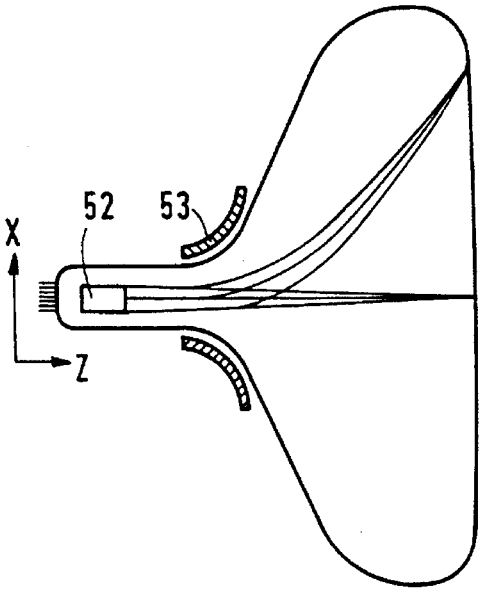
FIGS. 3 and 4 are diagrammatic cross-sections of colour display tube systems illustrating some aspects of the invention with reference to the beam paths.
Figure 4:
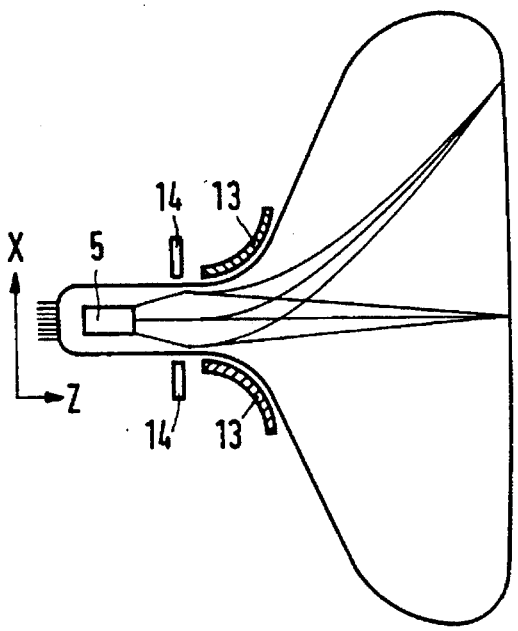

The use of the colour display tube system according to the invention is particularly suitable in high-resolution monitors and in future HDTV apparatuses, particularly in those cases where the aspect ratio of the display screen is larger than 4:3, notably 16:9. The recognition on which the invention is based will be further described with reference to FIGS. 3 and 4 showing diagrammatic cross-sections of colour display tubes. FIG. 3 shows a state-of-the-art colour display tube with an electron gun 52 which produces statically converged electron beams and a dynamically converging system 53 of deflection coils. The electron beams converge throughout the display window.

FIG. 4 shows the principle of a colour display tube system according to the invention with a system 13 of line deflection coils. Electron gun 5 is constructed in such a way that the outer beams diverge. Convergence-producing element 14 compensates this divergence. As a result, the spot dimension in the horizontal direction at the ends of the horizontal display screen axis is reduced with respect to that occurring in the system of FIG. 3. A further advantage is that the spot shape may be more homogeneous (more circular). In the known state of the art, the horizontal dimension of the spot at the edges of the display screen is considerably larger than the vertical dimension. A more homogeneous spot shape is desired, particularly for data displays.

Figure 5:
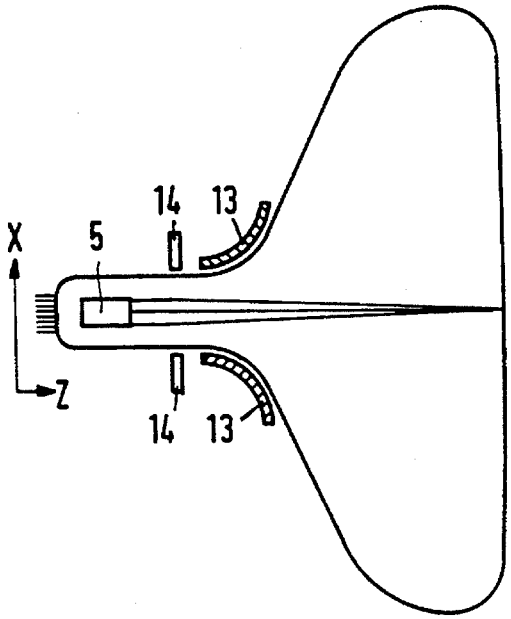
FIG. 5 shows an example of an alternative beam path within the scope of the invention.

FIG. 5 shows a modification in which electron gun 5 produces parallel beams and element 14 ensures the convergence. The advantage of this modification is that the electron gun may have a simpler construction. Such a gun may comprise, for example, three parallel electrically insulated tubes whose inner surfaces carry high ohmic resistance structures which constitute a focusing lens.

Figure 8:
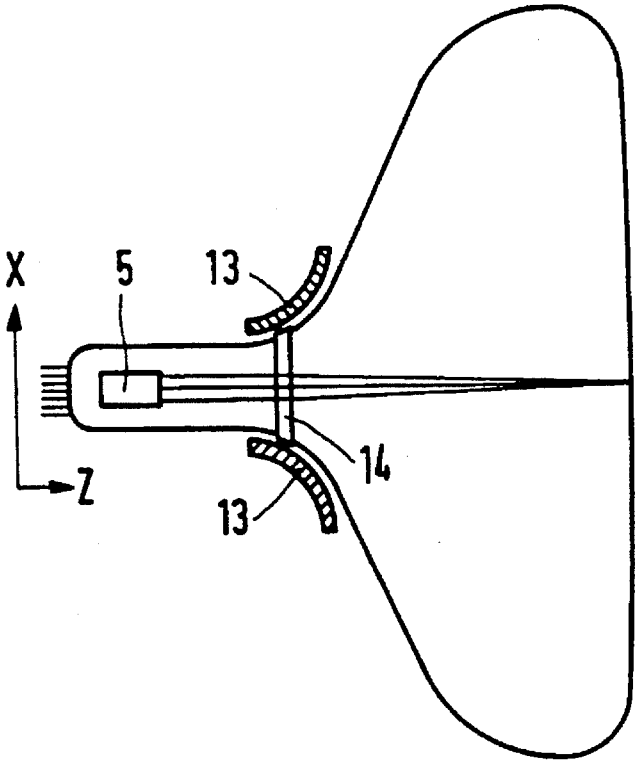
FIG. 8 is a longitudinal section of a colour display tube system according to the invention, with a special location of the 4-pole element of FIG. 2A.

It can be ensured with the aid of the afore-described means that the spot is very small in a colour display tube using self-convergent deflection fields. For high-resolution applications the spot should not only be small but it should also remain in focus as much as possible when it is deflected across the screen. An additional advantage is obtained if the convergence means according to the invention are used in combination with an electron gun having a dynamic astigmatic focusing facility, known as the DAF gun. The required dynamic focusing voltage of such a gun appears to be considerably decreased due to the presence of the 45° 4-pole. The required dynamic focusing voltage decreases as the 45° 4-pole is arranged further remote from the gun. This is particularly important when using elongate guns or when using guns having a focusing lens extending over a considerable axial area, such as focusing lenses constituted by a (helical) high-ohmic resistance structure. Elongate guns with a dynamic astigmatic focus require an extra large amount of dynamic voltage. FIG. 8 shows an embodiment which provides the possibility of arranging the 45° 4-pole element 14 within the coil system 13 at a large distance from gun 5. In this case element 14 is of the permanent magnet type shown in FIG. 2A. It is to be noted that the (funnel-shaped) annular element 14 of FIG. 2A may have a corrugated outer edge with which a sinusoidal variation of the field strength along the inner surface is achieved, which improves the purity of the 4-pole field.

Figure 9:
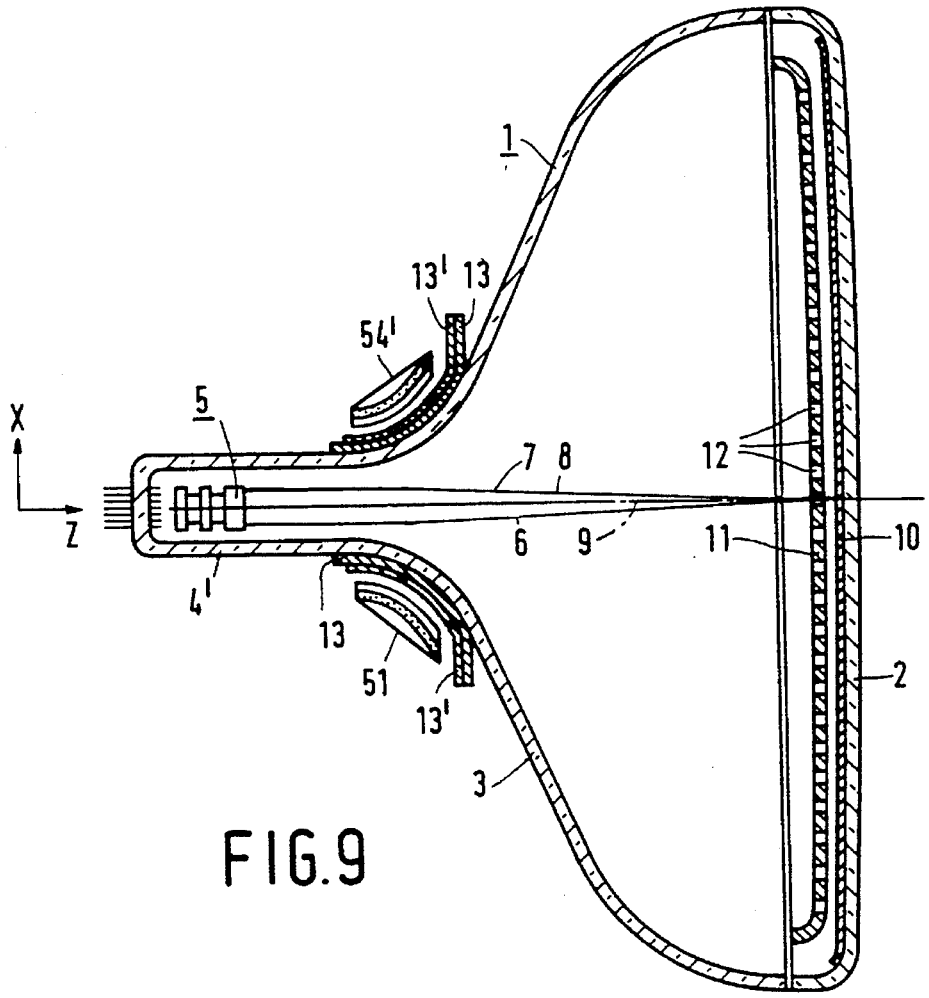
FIG. 9 is a longitudinal section of a colour display tube system according to the invention, with a convergence-producing element 54' wound on the deflection yoke.
Figure 10:
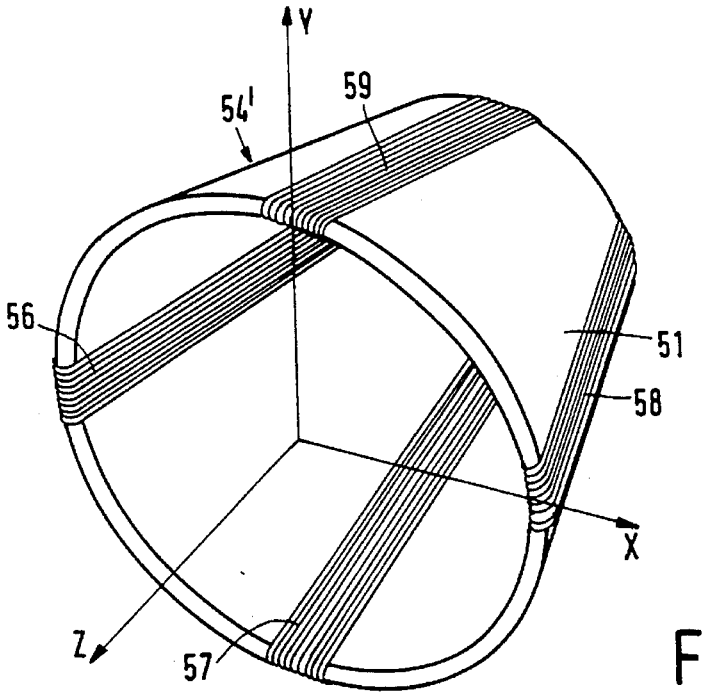
FIG. 10 is a perspective elevational view of the element 54'.

FIG. 9 shows an alternative embodiment of a colour display tube system according to the invention. In this embodiment the tube has a convergence-producing element 54' for driving the puter electron beams toward each other, which element comprises a coil configuration arranged on the annular core 51 of the deflection unit. FIG. 10 shows the annular core 51 of the deflection unit with coil configuration 56, 57, 58 and 59, which is connectable to a voltage source in such a way that a 4-pole field having an orientation for driving the outer beams towards each other is generated. In this case the neck 4' of the colour display tube system 1' may be shorter than the neck 4 of the system 1 in FIG. 1A.

We claim:

1. A color display tube system comprising:

an evacuated tubular envelope having a neck, a display window and a conical section there-between;

an electron gun in the tube neck, said gun having an electrode system for generating a central electron beam and two outer electron beams whose axes are co-planar; and a deflection unit positioned around a portion of said conical section for generating magnetic fields for deflecting the electron beams in the horizontal and vertical directions so as to scan the display window by means of convergent beams;

characterized in that:

the electron gun produces non-convergent electron beams; and a convergence element for producing beam convergence is arranged coaxially around said envelope between the electron gun and the side of the deflection unit facing said display window, said convergence element comprising means for generating a four-pole magnetic field having components directed along first and second orthogonal axes which are at angles of 45° relative to the plane of the axes of said beams;

the field components along the first of said orthogonal axes all being directed toward the central beam and exerting a force on each outer beam having a component in said axial plane directed toward the central beam; and the field components along the second of said orthogonal axes all being directed outwardly from the central beam and exerting a force on each outer beam which enlarges an apex angle thereof to thereby reduce the width of the scanning spot formed by each electron beam on the display window.

2. A colour display tube system as claimed in claim 1, characterized in that the convergence element is arranged within the deflection unit.

3. A color display tube system as claimed in claim 1, characterized in that the electron gun comprises a quadrupole field lens which is statically or dynamically energizable to compensate for astigmatic defocusing of the electron beams.

4. A colour display tube system as claimed in claim 1, characterized in that the display window has an aspect ratio of approximately 9:16.

5. A color display tube system comprising an envelope having a display window bearing a luminescent screen, containing an electron gun for producing a plurality of electron beams having coplanar axes, and supporting deflection means for producing a deflection field for deflecting the electron beams across the screen, characterized in that:

a. outer electron beams produced by the electron gun are non-convergent;

b. magnetic-field-producing means is disposed between the electron gun and an end of the deflection means which is closest to the display window, for producing a convergence field for forcing the electron beams together; and c. said deflection field and said convergence field cooperate to effect convergence of the electron beams at the screen as said beams are deflected across said screen.

6. A color display tube system comprising an envelope having a display window bearing a luminescent screen, containing an electron gun for producing a central and first and second outer electron beams having coplanar axes, and supporting deflection means for producing a deflection field for deflecting the electron beams across the screen, characterized in that:

a. the first and second outer electron beams produced by the electron gun are non-convergent;

b. magnetic-field-producing means is disposed between the one electron gun and an end of the deflection means which is closest to the display window, for producing a convergence field for forcing the first and second outer electron beams toward the central electron beam; and said deflection field and said convergence field cooperate to effect convergence of the electron beams at the screen as said beams are deflected across said screen.

7. A color display tube system as in claim 5 or 6 where the first and second outer electron beams produced by the electron gun have respective apex angles which are separately enlarged in a direction which said electron beams are deflected.

8. A color display tube system as in claim 5 or 6 where the magnetic-field-producing means comprising means for producing a four-pole magnetic field having components directed along first and second orthogonal axes which are at angles of 45° relative to the plane of the axes of said electron beams.

9. A color display tube system as in claim 8 where the electron gun includes a quadrupole-lens-field-producing means which, in operation, compensates for astigmatic defocusing of said electron beams.

10. A color display tube system as in claim 9 where a field produced by said quadrupole-lens-field producing means comprises a static field component.

11. A color display tube system as in claim 9 where a field produced by said quadrupole-lens-field producing means comprises a dynamic field component.

12. A color display tube system as in claim 5 or 6 where the magnetic-field-producing means is arranged within the deflection means.

13. A color display tube system as in claim 5 or 6 where the display window has an aspect ratio of approximately 9:16.

14. A color display tube system as in claim 5 or 6 where the outer electron beams produced by the electron gun are divergent.

15. A color display tube system as in claim 5 or 6 where the outer electron beams produced by the electron gun are parallel.

* * * * *